United States Patent [19]

Willmann et al.

[11] 4,085,717

[45] Apr. 25, 1978

[54] ATOMIZATION DEVICE FOR INTERNAL COMBUSTION ENGINES

[75] Inventors: Karl Willmann, Buchenbach; Helmut Säufferer, Esslingen, both of Germany

[73] Assignee: Daimler-Benz Aktiengesellschaft, Germany

[21] Appl. No.: 684,194

[22] Filed: May 7, 1976

[30] Foreign Application Priority Data

May 13, 1975 Germany ..... 2521141

[51] Int. Cl.[2] ..... F02B 51/04; F02M 29/00

[52] U.S. Cl. ..... 123/119 E; 123/141

[58] Field of Search ..... 123/119 E, 141

[56] References Cited

U.S. PATENT DOCUMENTS

| | | | |
|---|---|---|---|
| 3,266,783 | 8/1966 | Knight | 123/119 E |
| 3,841,824 | 10/1974 | Bethel | 123/119 E |
| 4,034,728 | 7/1977 | Saufferer | 123/119 E |

FOREIGN PATENT DOCUMENTS

| | | | |
|---|---|---|---|
| 714,015 | 8/1954 | United Kingdom | 123/119 E |

*Primary Examiner*—Ronald H. Lazarus

*Attorney, Agent, or Firm*—Craig & Antonelli

[57] ABSTRACT

An atomization system for internal combustion engines for atomizing fuel in an air stream, which includes an atomization space separate from the combustion or working space of the internal combustion engine and traversed at least in part by the combustion air; the electrically conductive fuel supply includes a large number of small capillary tubes projecting into the atomization space from the mounting support thereof while a counter-electrode is provided with a large surface facing the discharge openings of the capillary tubes; additionally, means are provided for guiding the air in such a direction and at such a velocity that the forces exerted on the atomized and electrically charged fuel droplets by the flowing air predominate the electrostatic attracting forces exerted on the droplets by the counter-electrode and thus keep the droplets from the counter-electrode.

45 Claims, 9 Drawing Figures

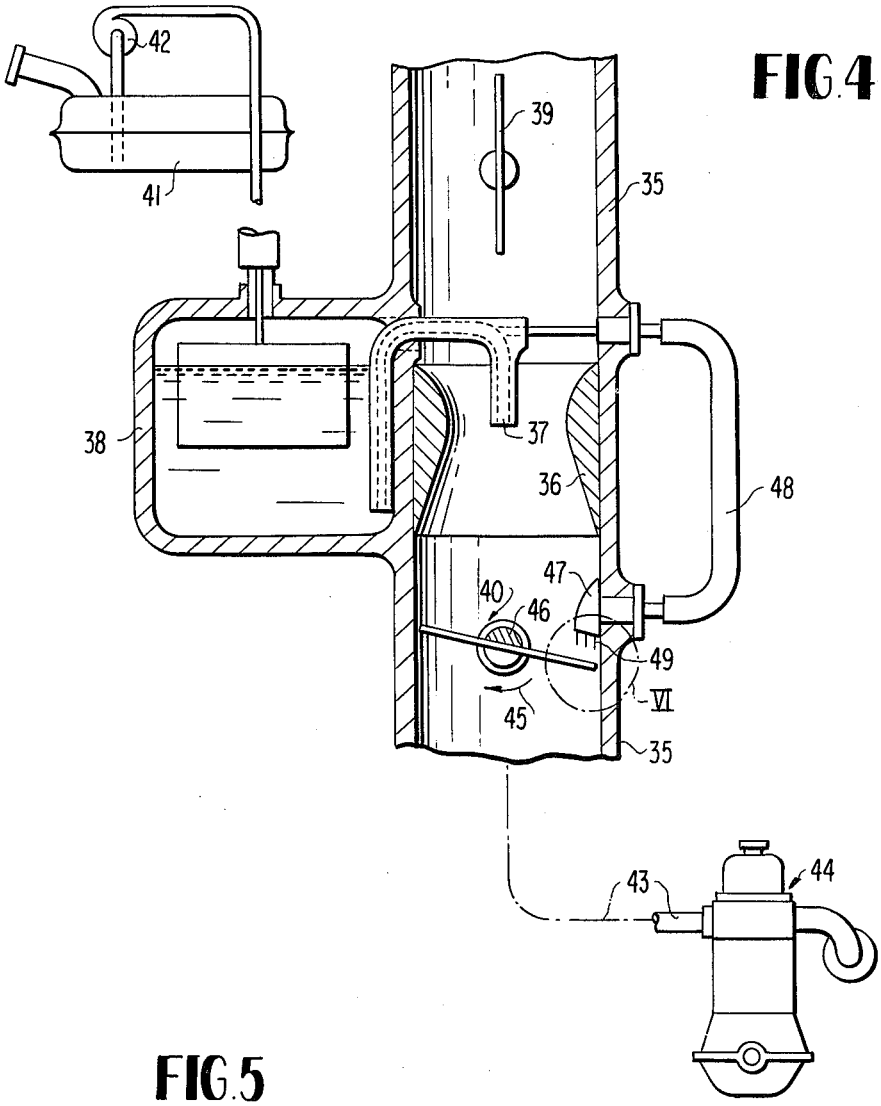
FIG. 4
FIG. 5
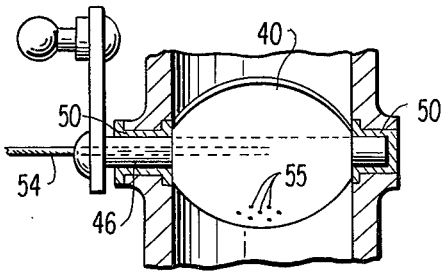

ATOMIZATION DEVICE FOR INTERNAL COMBUSTION ENGINES

The present invention relates to an atomization system for internal combustion engines for atomizing fuel in an air stream, with an atomization space separate from the combustion or working space of the internal combustion engine and traversed in orderly flow at least by a part of the combustion air, in which terminates the electrically conductive fuel supply projecting freely into the atomization space, additionally with a counter-electrode electrically insulated with respect to the fuel supply and disposed opposite the fuel supply as well as with a high voltage source connected, on the one hand, with the fuel supply and, on the other, with the counter-electrode.

It is known that within an electric field the surface tension of liquids is lowered in its effect holding together the liquid particles and this phenomenon can be applied usefully to the atomization of liquids. Proposals have appeared repeatedly to apply this electrostatic liquid atomization also to the mixture production for internal combustion engines. The system desired hereinabove can be found, for example, in the German Pat. No. 483,912.

The prior art proposals apparently have not passed beyond the state of the basics and the existing places in the literature disclose only such installations in which the electrostatic atomization effect can possibly be proved but is completely uninteresting in its extent from a technical point of view. The required expenditure was therefore not worthwhile and, accordingly, the possibility of an electrostatic liquid atomization has therefore apparently not found heretofore an acceptance in the practice of the mixture preparation for internal combustion engines.

It is the aim of the present invention to provide measures how the aforementioned atomization installation can be improved in such a manner that the effect of the electrostatic liquid atomization occurs to a technically interesting extent under the restricted space conditions of an internal combustion engine or of the auxiliary aggregates thereof and how this effect can be applied usefully in practice.

The underlying problems are solved according to the present invention by a combination of the following features, individually contributing to the solution:

(a) A number of respectively small capillary tubes are provided as fuel supply which are traversed jet-free by the fuel liquid, project freely from their mounting support into the atomization space and are electrically connected with each other;

(b) The counter-electrode is constructed areal and is arranged facing with the electrode surface thereof the discharge openings of the small capillary tubes; and (c) Means for the air conduction are provided with conduct the air— at least within the area of the counter-electrode—in such a manner according to flow velocity and flow direction that the forces which are aerodynamically exerted by the flowing air on the atomized and electrically charged droplets, predominate with respect to the electrostatic attracting forces exerted by the counter-electrode on the droplets and keep the droplets away from the counter-electrode.

The large number of fuel discharge openings is required for various reasons, and more particularly, on the one hand, the inflow velocity into the atomization space is to take place jet-free and quasi-stationary, i.e., a sufficiently large over-all flow cross section must be made available. The quasi-stationary inflow of the fuel liquid into the atomization space is required in order that the electrostatic forces can seize simultaneously the entire flow cross section. With a jet the electrostatic forces can seize exclusively the liquid particles of the jet near the edge whereas the liquid particles disposed further inwardly fly uninfluenced through the electric field and would be removed rapidly from its influence. The subdivision of the large overall flow cross section into many small individual cross sections is required because the length of the boundary edges of the discharge cross section should be as large as possible. This is so as the effect of the electrostatic liquid atomization is particularly large within the rim area of the boundary edge of discharged liquid cross section.

The free and relatively long projection of the small capillary tube from its mounting support is to be seen in conjunction with the areal construction of the counter-electrode extending transversely thereto. A plate-shaped electrode is disposed opposite a rod pointing with the tip against the plate, so to speak of. By reason of this electrode construction, a field increase will result within the area of the discharge openings of the small capillary tubes; most of the field lines starting from the areal counter-electrode are concentrated onto the capillary tip or onto the wall edges. This field concentration is the greater, the larger the area ratio of capillary tip to the area of the counterelectrode facing the capillary tip. A very high field strength gradient will accordingly develop locally at the discharge place which is considerably larger than the field strength averaged over the entire electric field. It must thereby be taken into consideration that the voltage difference at the electrodes must remain below the arc-over limit. The magnitude depends, in addition from the electrode distance, also from the conductivity and from the dielectric strength of the respective liquid fuel and from the pressure in the atomization space. The physical values of the fuel liquid may be quite different depending on the type of fuel and on the additives used therein. The average field strength is therefore determined as to its maximum possible magnitude by the arc-over voltage and cannot be increased therebeyond (arcing-over limit). Owing to the intentionally adduced field non-homogeneity, it will lead locally to a drastic increase or superelevation of the field strength within the area of the discharge openings notwithstanding the preservation of the arcing-over limit. The field strength at this place is determinative in the first instance for the extent of the atomization effect.

In addition to the above-described measures according to the present invention of the subdivision of the discharge cross section over many individual cross sections and of the field increase at the capillary tips, additionally a third measure, namely that of the impact-avoidance is provided according to the present invention. The electrostatically atomized droplets receive an electric charge which corresponds in its polarity to that of the capillary tubes. The droplets are therefore charged negatively with respect to the counter-electrode and, accordingly, an attracting force is exerted electrostatically on the small drops by the counter-electrode. In order not to destroy the efforts for a fuel atomization by the impact of the droplets at the electrode and by coagulation, a wall impact is avoided by an orderly air conduction and guidance.

Appropriately, provision may be made that the mutual distance of the small capillary tubes—at least within the area of the discharge openings thereof—is larger than the distance of the discharge openings to the counter-electrode. The relatively large dimension of the mutual distance of the small capillary tubes is provided for the reason in order to disturb mutually the individual electric fields between the individual capillary tips and the counter-electrode. The above-described field line concentration would be impaired thereby.

For the purpose of a similar goal, provision may be made that the freely projecting length of the small capillary tubes is a multiple of the outer diameter of the small capillary tubes within the area of the discharge openings, preferably is larger than the distance to the counter-electrode. The special configuration of the electric fields between the capillary tip and the counter-electrode should not be disturbed by the metallically conducting mounting support of the capillaries. However, also an embedding of the small capillary tubes into an insulating mass which is too close to the capillary tip is harmful. This is so as the surface of the insulator may become charged—by polarization of the dielectric.

Such an areally distributed charge, if it extends to the proximity of the capillary tip, may impair the desired field non-homogeneity in the direction toward a more homogeneous field, or at least may effect a lowering of the field strength at the capillary tip.

In order to construct the tip of the small capillary tubes as small as possible, provision is made that the wall thickness of the small capillary tubes is as small as possible at least within the area of the discharge openings. The small capillary tubes are appropriately selected so thin in wall thickness over their entire length that they just barely satisfy with safety the requirements as regards strength and rigidity (breakage safety when being dropped or when being forcibly gripped).

In order to be able to utilize optimally the electrode surface adapted to be spatially accommodated, the counter-electrode is advantageously arranged relative to the small capillary tubes in such a manner—taking into consideration the arcing-over limit—that the freely exposed electrode surface— as viewed from any discharge opening of the small capillary tubes—appears under a solid which is as large as possible whereby, however, the distance of freely exposed portions of the electrode to other freely exposed parts of the atomization installation electrically conductively connected with the small capillary tubes is larger than with respect to the small capillary tubes. Consequently, not only alone the area of the counter-electrode but also the angular position and the distance of the individual area portions with respect to or from the capillary tip is relevant. Too great an approachment of electrode portions to the capillary mounting support must be avoided by reason of a danger of arc-overs; too great a removal of the electrode away from the capillaries in the direction of the air flow must also be avoided because otherwise the distance, over which the electrostatic attracting forces of the counter-electrode are effective, becomes too long and the danger of a droplet impact on the electrode nonetheless still exists. As to the rest, area or surface portions of the electrode which appear under a very acute solid angle—as viewed from the capillary tip—are hardly effective anymore in the sense of a field increase or field concentration.

The air conduction may be so constructed in one embodiment of the present invention that the small capillary tubes are arranged approximately parallel to the air stream and the counter-electrode transversely to the air stream and that a through-flow opening is arranged in the counter-electrode coaxially to a respective small capillary tube each. The capillaries are then arranged approximately parallel among each other like the bristle of a brush. With a small number of capillaries, the air may be conducted about the mounting support of the capillaries whereas with a larger number, the air must also be conducted between the capillaries. The counter-electrode is constructed as an apertured plate arranged transversely in the air stream. Since the air can pass only through the holes or openings, a sink-or constriction-flow with streamlines directed toward the hole is formed within the area of each through-flow opening. This sink- or constriction-flow tears the atomized droplets through the opening free of contact notwithstanding the attraction force on the part of the counter-electrode. It is thereby appropriate if the openings are dimensioned as small as possible—under preservation of the limits of maximum permissive air velocities. The sink- or constriction-flow is enhanced thereby. The flow losses through the openings can be reduced and the surface portions of the counter-electrode facing the capillary tips may be enlarged if the edges of the through-flow openings are chamfered off or rounded off an the side facing the small capillary tubes.

Frequently, the electrostatic fuel atomization is required only in partial ranges of the operation of the internal combustion engine, for example, during idling and in the lower partial load range or during the cold-start because in the remaining ranges, heretofore proven, conventional atomization installations, for example, Venturi carburetors with a throttle valve, produce a sufficiently fine air/fuel mixture. In order to be able to accommodate in such proven installations without great changes, an additional installation for an electrostatic fuel atomization effective only during the start and/or during the idling and in the lower partial load range of the internal combustion engine, provision may be made that the large number of small capillary tubes is arranged upstream of the throttle valve, as viewed in the flow direction, within an area of the throttle valve movable in the downstream direction, preferably at a place near the wall, and is electrically insulated with respect to the throttle valve and in that the throttle valve or at least a part thereof serves as counter-electrode and is provided with one through-flow opening each approximately coaxially to a respective capillary tube. The small capillary tubes are to be arranged in relation to the throttle valve in such an axial position inside of the flow channel that in the closed condition of the throttle valve, the electrode distance required for an effective fuel atomization exists. In the closed condition of the throttle valve, the proportion of the air flowing through at the gaps between the valve and the channel wall is particularly small and the air sucked in by the combustion engine is, for the most part, forced to flow through the through-flow openings provided in the electrode area of the throttle valve in the form of a sink- or constriction-flow and to tear along the atomization droplets starting from the capillaries. With an opening throttle valve, the electrode distance increases and thus the field strength decreases very rapidly; additionally, the proportion of the air passing through the through-flow openings decreases very rapidly so that one has to reckon with an increased wall impact. This lessening of the electrostatic fuel atomization with an opening throttle valve, however, can be accepted because Venturi carburetors possess a sufficiently good atomization characteristic with an also only partly opened throttle valve.

An appropriate construction of this auxiliary atomization installation as described above may consist in that the small capillary tubes are electrically conductively connected with the metallic flow channel and the metallic throttle valve is supported electrically insulated and—except for the area with the through-flow openings on the side facing the small capillary tubes—is coated with an insulating material of high dielectric strength. This is so as it may be more simple in some individual cases to insulate the throttle valve electrically with respect to the carburetor than the mounting support for the capillary tubes.

Another embodiment of an atomization installation according to the present invention resides in that the small capillary tubes are arranged transversely to the air stream and the counter-electrode is arranged parallel thereto. Owing to the position of the electrode arranged in the air stream, the atomized fog can be carried off laterally by the air sweeping past the same before the mist droplets have reached the proximity of the electrode. In order that the electrode need not extend excessively in the air flow directon—the danger of the droplet attraction would increase by a very long extension—, the small capillary tubes are appropriately arranged at least approximately along a line extending transversely to the flow direction. This means, the small capillary tubes are to be arranged in a single row and not, for example, in a double row or multiple rows or in a zig-zag row and the electrode can be constructed accordingly narrower.

An appropriate embodiment of the atomization installation according to the above-described principle, especially for gas turbine systems, may consist in that the small capillary tubes are arranged radially preferably in a uniform axial plane at a nozzle stock or assembly extending in the air flow direction and in that the counter-electtode is constructed as a cylindrical ring electrode disposed in the direction of the air stream. A small increase of the number of capillaries and accordingly of the atomization quantity is attainable in that the nozzle assembly is constructed as double-walled cylinder, in that the small capillary tubes are arranged projecting radially outwardly and radially inwardly and in that one ring electrode each disposed in the air stream is arranged about the outer capillary rim and on the inside of the inner capillary rim. The outer and the inner ring electrode may thereby be constructed cylindrically; whence both ring electrodes can be constructed in a very simple manner. The surface facing the capillary tips can be increased at the inner capillary rim and the effect of the field increase can be reinforced if the inner ring electrode is constructed garland-shaped with several outwardly concave arcuate parts, whose respective centers coincide at least approximately with the location of the discharge opening of a coordinated small capillary tube of the inner capillary rim. Attention must be paid with the distribution of the capillaries over a large air stream cross section, that an equal number of capillaries is installed at least approximately per area unit flow cross section in order that an approximately uniformly composed air/fuel mixture results over the entire flow cross section.

Accordingly, it is an object of the present invention to provide an atomization system for internal combustion engines which avoids by simple means the aforementioned shortcomings and drawbacks encountered heretofore in the prior art.

Another object of the present invention resides in an atomization installation for internal combustion engines which makes possible the practical application of electrostatic atomization in internal combustion engines.

A further object of the present invention resides in an atomization installation for internal combustion engines which produces a technically interesting atomization of the fuel, notwithstanding the constricted space conditions which exist in the internal combustion engine and in the auxiliary aggregates thereof.

A still further object of the present invention resides in an atomization installation for internal combustion engines in which a sufficiently large overall flow cross section is available in order that the electrostatic forces are able to act upon the entire flow cross section simultaneously so that all liquid particles are substantially equally affected by the electrostatic forces.

Still another object of the present invention resides in an electrostatic atomization system for internal combustion engines which produces a local field super-increase within the areas of interest, yet preserves the limits assuring prevention of arcing-over.

Still a further object of the present invention resides in an atomization installation for internal combustion engines in which an effective electrostatic atomization of the fuel particles is achieved while a wall impact of the charged particles is effectively prevented by simple means.

These and other objects, features and advantages of the present invention will become more apparent from the following description when taken in connection with the accompanying drawing which shows, for purposes of illustration only, several embodiments in accordance with the present invention, and wherein:

FIG. 4 is a schematic view of a Venturi carburetor and its incorporation in the fuel and mixture supply of a reciprocating piston internal combustion engine equipped with an electrostatic auxiliary atomization installation according to the present invention with the throttle valve as counter-electrode;

FIG. 5 is a cross-sectional view through the throttle valve mounting support of FIG. 4 and taken at right angle to FIG. 4;

Figure 1:
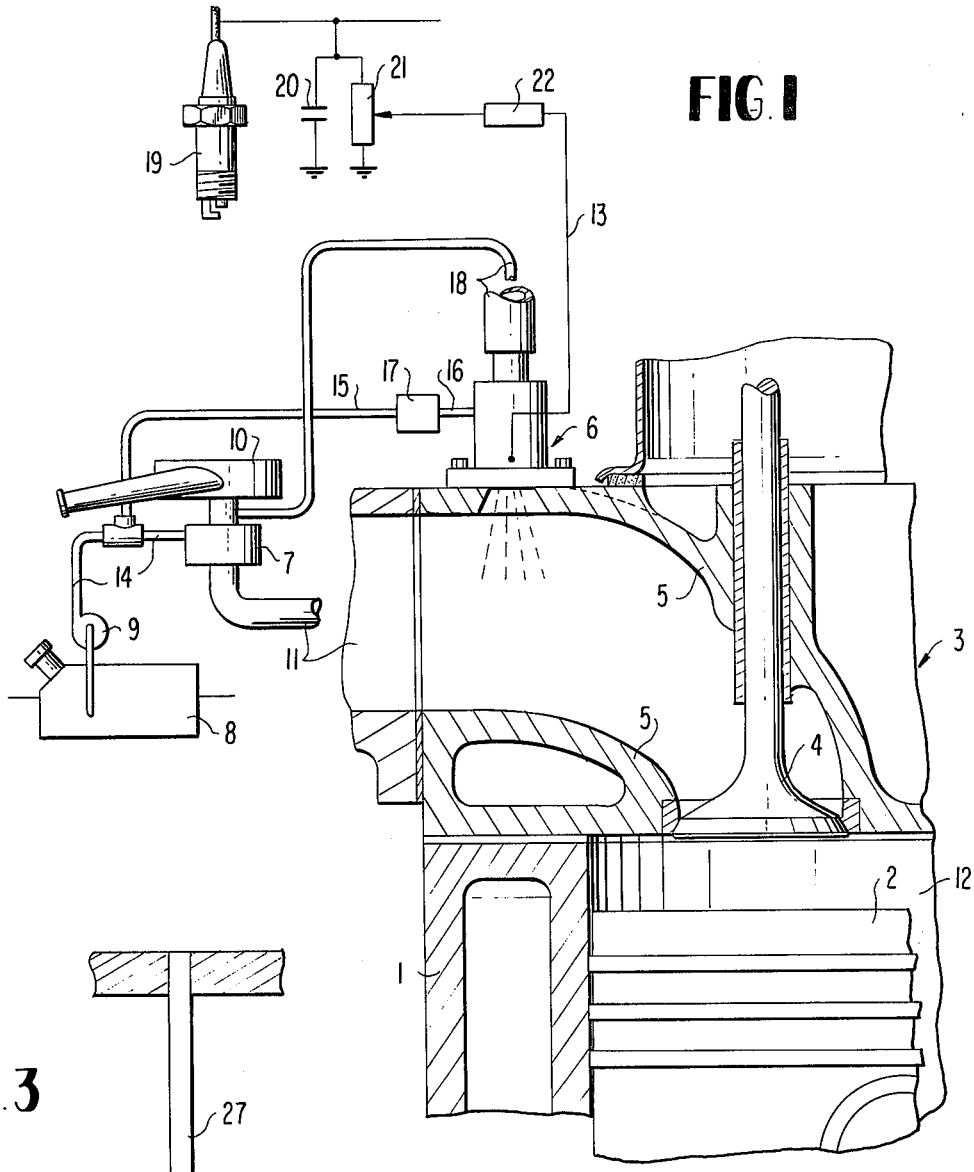
FIG. 1 is a schematic view, partly in cross section, of an electrostatic atomization installation for starting and idling purposes arranged at the suction pipe of a reciprocating piston internal combustion engine, shown only partly, which is provided in addition to a conventional carburetor.
Figure 3:
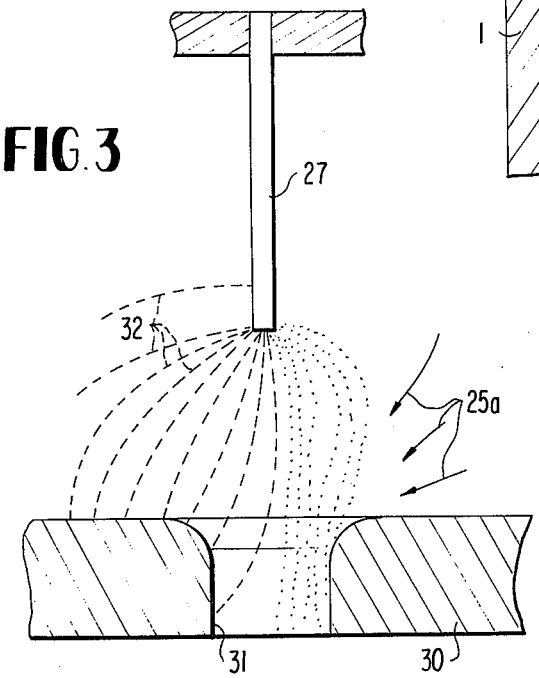
FIG. 3 is a partial somewhat schematic cross-sectional view through a detail of the atomizaton installation according to FIG. 2.
Figure 2:
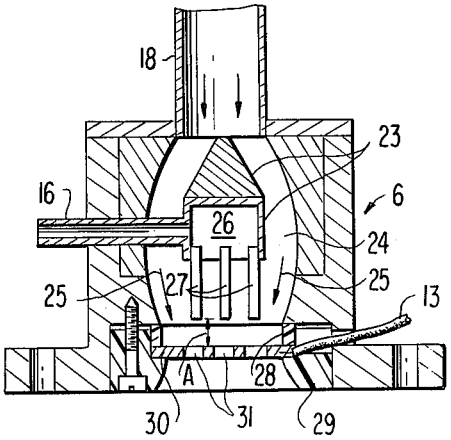
FIG. 2 is a partial cross-sectional view through the atomization installation according to FIG. 1, on an enlarged scale.

Referring now to the drawing wherein like reference numerals are used throughout the various views to designate like parts, and more particularly to FIGS. 1 to 3, a reciprocating piston internal combustion engine with an engine block 1, a piston 2, a cylinder head 3, an inlet valve 4, a suction channel 5, and an electrostatic atomization installation generally designated by reference numeral 6 is partly shown in cross section in FIG. 1. A conventional Venturi carburetor 7 is coordinated to the engine in addition to this atomization installation 6, which is supplied with gasoline from the the gasoline tank 8 by way of the fuel feed pump 9. The combustion air sucked in by the reciprocating piston is at first cleaned in the air filter 10 and is enriched with fuel in the carburetor 9 and reaches the working space 12 of the internal combustion engine by way of the suction line 11, the suction channel 5 and the inlet valve 4.

The atomization installation 6 is moved as close as possible to the inlet valve 4 in order that the flight distance of the fine, produced mist droplets up to the working space 12 is as short as possible and the possibility of wall impact and droplet coagulation is as slight as possible. The installation 6 with its electrically conductive housing is electrically conductively connected with the cylinder head 3 and as a result thereof is also placed electrically at ground or at the potential zero like the cylinder head 3. The electrode to be described more fully hereinafter is adapted to be put at a predetermined potential by way of a cable 13 extending toward the outside. The atomization installation 6 is also connected with the fuel supply of the internal combustion engine by way of a fuel line 15 branching off from the main fuel line 14. A quantity control device 17 of any conventional construction is arranged upstream of the inflow 16 into the atomization installation 6, which may be constructed as float chamber system or the like. The atomization installation 6 is also connected on the air-side with the mixture preparation system by way of a branch line 18 branching off downstream of the air filter 10. Air is sucked by the vacuum in the suction channel 5 through the atomization installation 6 by way of the line 18.

The electrode (not shown in FIG. 1) of the atomization installation 6 can be brought to an electrical potential from a storage condenser 20 of high dielectric strength and high charge velocity which is electrically connected in parallel to the spark gap of the spark plug 19 of the internal combustion engine and which is charged by the ignition pulses. The magnitude of the potential (approximately 2.5 to about 5 kV) can be picked up at the sliding resistor or potentiometer 21 connected in parallel to the storage condenser 20. A high ohmic resistance 22 (approximately 20 M Ω ) is arranged additionally in the voltage feed to the electrode of the atomization installation 6 which is to prevent that in case of an arcing-over of the voltage in the atomization installation, a significant current might flow and a powerful arc-over spark might form thereat (current-limiting resistance).

In detail, the atomization installation 6 is constructed as follows:

A flow cross section 24 (FIG. 2) for the air is left ring-shaped about a displacement body 23 held in a self-supporting manner and constructed favorably from a streamlining point of view. The displacement body 23 which is at least partially constructed hollow, thereby forming the hollow distributor space 26, is offset sharp-edged on the flow shadow side and carries on the thus formed, flattened-off portion an increased number of small capillary tubes 27 extending parallel to the air stream indicated by flow arrows 25, which capillary tubes 27 are conductively connected with the hollow distributor space 26. The hollow distributor space 26, in its turn, is connected toward the outside with the gasoline supply line 16. The small capillary tubes 27 are electrically conductively connected with the housing of the installation and are thus placed at the ground potential zero.

An apertured plate 30 is arranged transversely to the air stream held in predetermined axial and circumferential position—between rings 28 and 29 of electrically well-insulating material—which plate is electrically insulated with respect to the housing of the installation and is connected with a cable 13 leading toward the outside. The openings 31 are so arranged in the plate 30 and the same is so built into the installation that one opening each is arranged coaxially to a respective small capillary tube 27.

For a good effect of the atomization installation, one should also point out the following constructional features. The small capillary tubes 27 are very slender—insofar as their freely projecting length is concerned—i.e., they are considerably longer than thick. The distance A (FIG. 2) of the apertured plate 30 with respect to the capillary tips is approximately the same for all capillaries and, on the one hand, is as small as possible but, on the other hand, is so selected—taking into consideration the relevant influence factors, namely, the selected electrode potential, the pressure in the atomizing space, the conductivity and dielectric strength of the fuel liquid—that the arcing-over limit is preserved. The mutual distance of the small capillary tubes 27 is at least approximately as large as the electrode distance A; the freely projecting length of the small capillary tubes 27 is larger than the electrode distance. The small capillary tubes 27 are selected very small both in inner diameter (for example, 0.4 mm) as also in wall thickness (for example, 0.1 mm) so that small discharge surfaces and altogether large edge lengths with a small pipe end area result. By reason of this arrangement and construction of the individual parts of the atomization installation, a large-surface counterelectrode is placed opposite the small capillary tubes, which appears under a large solid angle as viewed from the capillary tips. The rim edges of the through-flow openings 31 facing the small capillary tubes are rounded off, whence a through-flow with lower losses, a reduction of the impact danger and an increase of the surface proportion of the counter-electrode facing the capillary tips result.

The operation of the atomization installation will be explained by reference to FIG. 3. By reason of the juxtaposition of a large-surface counter-electrode 30 and of several small capillary tubes 27 to be considered respectively as electrode tips, with a potential difference applied between the two electrodes, a strong concentration of the field lines at the exposed capillary tips will occur, as indicated by the dash lines 32 in the left half of FIG. 3. In addition to the particularly exposed tip arrangement, also the ratio of the mutually oppositely disposed electrode surfaces or areas is decisive. The field line concentration at the capillary tip is in agreement with a local field strength superincrease, i.e., with a very strong field strength which lies consierably above the field strength averaged over the entire electrode distance. High field strengths can be locally maintained stable also without arcing-over. The high field strength is in the first instance decisive for the extent of the atomization. By reason of the field lines concentrated within the area of the liquid discharge, dissociating forces counter-acting the mechanical surface tension of the liquid are applied to the liquid which effect a dissociation or decomposition of the liquid into smallest droplets. The surface tension of the liquid particles which are disposed inside the electrostatic field with a locally increased field strength is temporarily decreased, so to speak of, to considerably lower values so that a dissociation of larger liquid conglomerations into smallest droplets occurs. Since the liquid is discharged quasi-stationary out of the capillaries, the time of the traversal of the area of large field strengths is relatively long and simultaneously the entire liquid cross-section is seized. The mist droplets are charged by the electrostatic dissociation and receive an electric charge determined in its polarity according to the small capillary tubes; the small droplets are therefore charged with the same polarity among one another and thus repel one another. The droplets therefore do not coagulate in free flight.

In contradistinction thereto, electrostatic attraction forces are exerted on the droplets by the counter-electrode 30. In order to now avoid a droplet coagulation by wall impact at the counter-electrode 30, the air flow in the fine area of the through-flow openings 31 is utilized. The air flow is constricted at the places of the openings 31 in the transversely arranged electrode plate 30 as indicated by flow arrows 25*a* in the right half of FIG. 3. This constriction or depression flow tears the mist droplets which initially scatter apart from one another from the capillary tip, contact-free through the electrode openings 31 as indicated by the dotted lines in the right half of FIG. 3. The air velocity increases more and more with increasing opening proximity so that with increasing approaching of the mist droplets at the electrode and accordingly with increasing electrostatic attracting forces, also the deflecting forces aerodynamically exerted on the droplets by the flowing air increase. Finally, the deflecting forces of the air-stream predominate as long as the through-flow openings 31 are not constructed too large.

Figure 6:
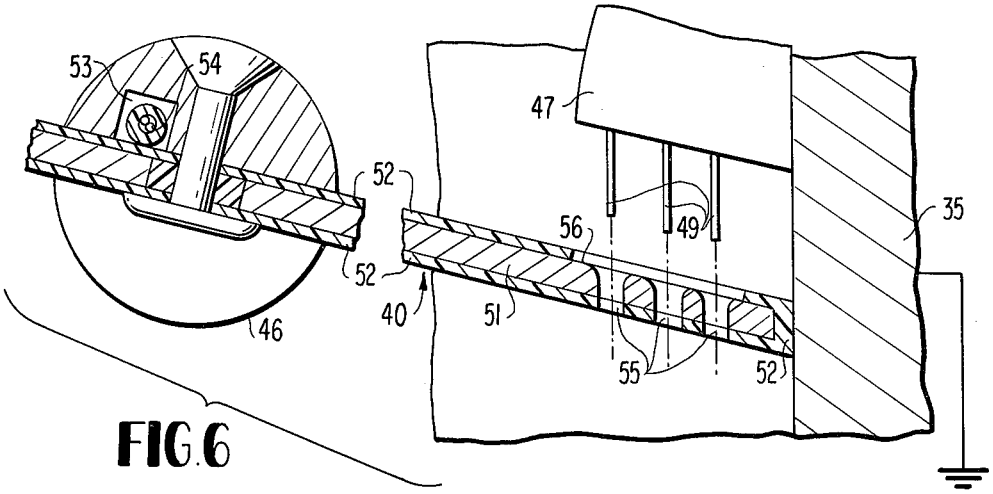
FIG. 6 is a partial cross-sectional view, on an enlarged scale; illustrating in detail the parts arranged in the dash and dot circle designated in FIG. 4 by VI.

The embodiment according to FIGS. 4 to 6 illustrates another application of an electrostatic atomization installation with an electrode disposed transversely in the air stream, and more particularly the throttle valve of a Venturi carburetor is used as electrode. FIG. 4 illustrates schematically a conventional Venturi carburetor including an air or mixture channel 35, a Venturi insert 36, a fuel main nozzle 37, a float-chamber 38, a starter valve 39, and a throttle valve 40. The fuel is fed to the carburetor from the tank 41 by the fuel pump 42. The formed air/fuel mixture reaches the associated internal combustion engine generally designated by reference numeral 44 by way of the suction line 43.

The throttle valve 40 is pivotal in the illustrated embodiment in the clockwise direction as indicated by the arrow 45 (FIG. 4). An additional nozzle assembly 47 (FIGS. 4 and 6) is arranged at a place near the wall on the side located upstream of the throttle valve 40, as viewed in the flow direction, within an area of the throttle valve 40 disposed to the right of the pivot axis 46, i.e., within an area of that part of the throttle valve movable in a downstream direction. This nozzle assembly 47 is constructed streamlined on the inflow side and is flattened off on its downstream side parallel to the position of the throttle valve in the closed condition. The nozzle assembly 47 is constructed hollow and is in communication by way of the line 48 with the fuel supply of the carburetor. A plurality of small capillary tubes 49 project from the flattened off side of the nozzle assembly 47, which are connected with the interior of the nozzle assembly. The nozzle assembly 47 and the small capillary tubes 49 are made of electrically conductive material and are connected with the body of the carburetor, i.e., are placed electrically at ground potential zero.

The throttle valve 40 is arranged electrically insulated in the carburetor channel 35. The shaft 46 is supported in bushes 50 (FIG. 5) of electrically insulating material of high dielectric strength. Within the area of the extent of the throttle valve disk the throttle valve shaft 46 is constructed semicircularly shaped in cross section so that the throttle valve disk can be riveted centrally to the flattened off portion of the shaft. The throttle valve disk consists of an electrically conductive plate 51 (FIG. 6) which is provided on all sides thereof with an electrically insulating cover 52 of high dielectric strength, for example, of polytetrafluoroethylene; also the walls of the rivet holes are coated with insulating material so that also the throttle valve disk is electrically insulated with respect to the throttle valve shaft. The throttle valve shaft 46 is bored hollow axially from one side thereof, or is provided with a groove 53 in which is located a voltage feed cable 54. The cable 54 is connected with the plate 51 at a suitable place. The insulating cover 52 is recessed at a relatively small place 56 facing the small capillary tubes and the plate lies exposed thereat on one side. The throttle valve is provided at this place with through-flow openings 55 which are arranged each approximately coaxially to a respective small capillary tube 49. The plate 51 can serve as counter-electrode for the small capillary tubes 49 owing to the metal surface freely exposed exclusively within the area of the place 56 and by reason of the potential raise possible by way of the cable 54.

The atomization effect of the atomization installation 47, 49, 55, 56 is essentially the same as that according to the embodiment of FIGS. 1 to 3. It should only be mentioned in that connection that the atomization installation displays a noticeable effect only in the closed or nearly closed condition of the throttle valve, i.e., in engine idling or in the low partial load range. The lessening of the atomization effect can be traced back to the increase of the electrode distance and to the occurrence of other, essentially larger sickleshaped through-flow openings (reduction of the constriction flows in the area of the openings 55). The lessening effect of the electrostatic atomization installation with higher engine outputs, however, can be accepted without any problem because the manner of operation of the Venturi carburetor at higher rates of fuel flow and with a warm engine is better. A mixture improvement is desirable above all during the start, when the engine is still cold, and the evaporating assist by hot places in the suction pipes is not utilizable, and in the idling, i.e., with low rates of fuel flow. In these operating conditions, the proportion of the fuel passing through the Venturi carburetor which has precipitated at the wall, in the so-called mixture is relatively large and causes a large amount of harmful components in the exhaust gas by reason of incomplete combustion of this liquid-rich mixture.

Figure 7:
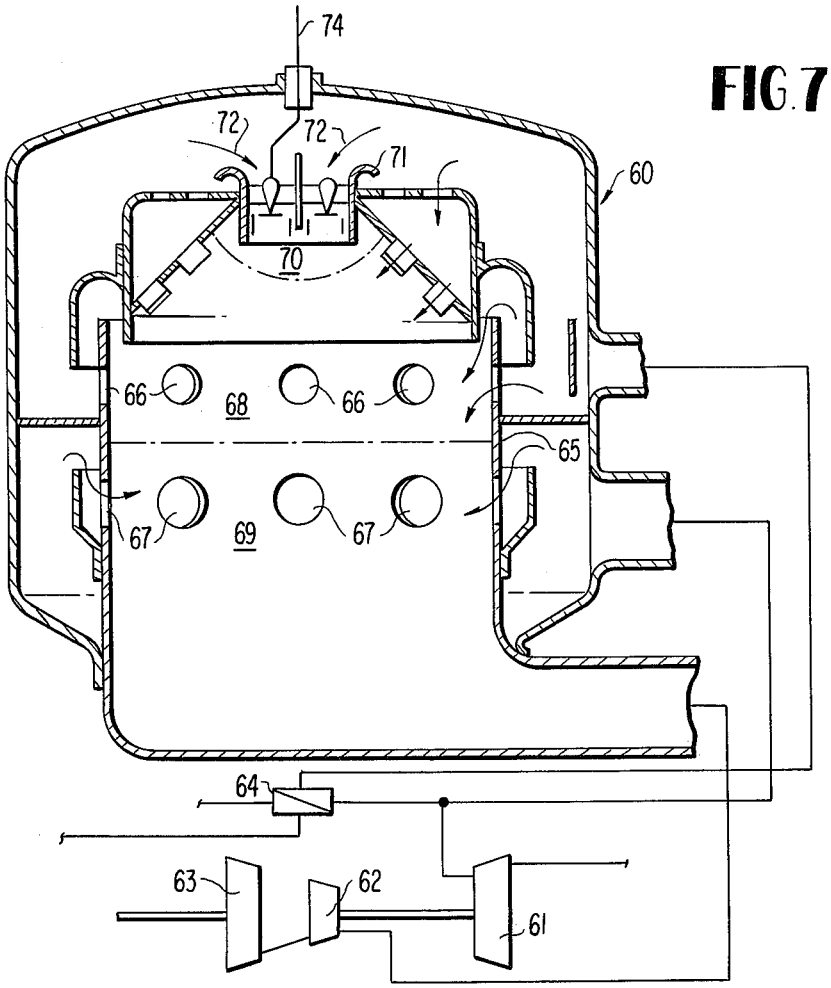
FIG. 7 is a schematic view, partly in cross section through the combustion chamber of a gas turbine installation with an electrostatic fuel atomization installation according to the present invention.
Figure 8:
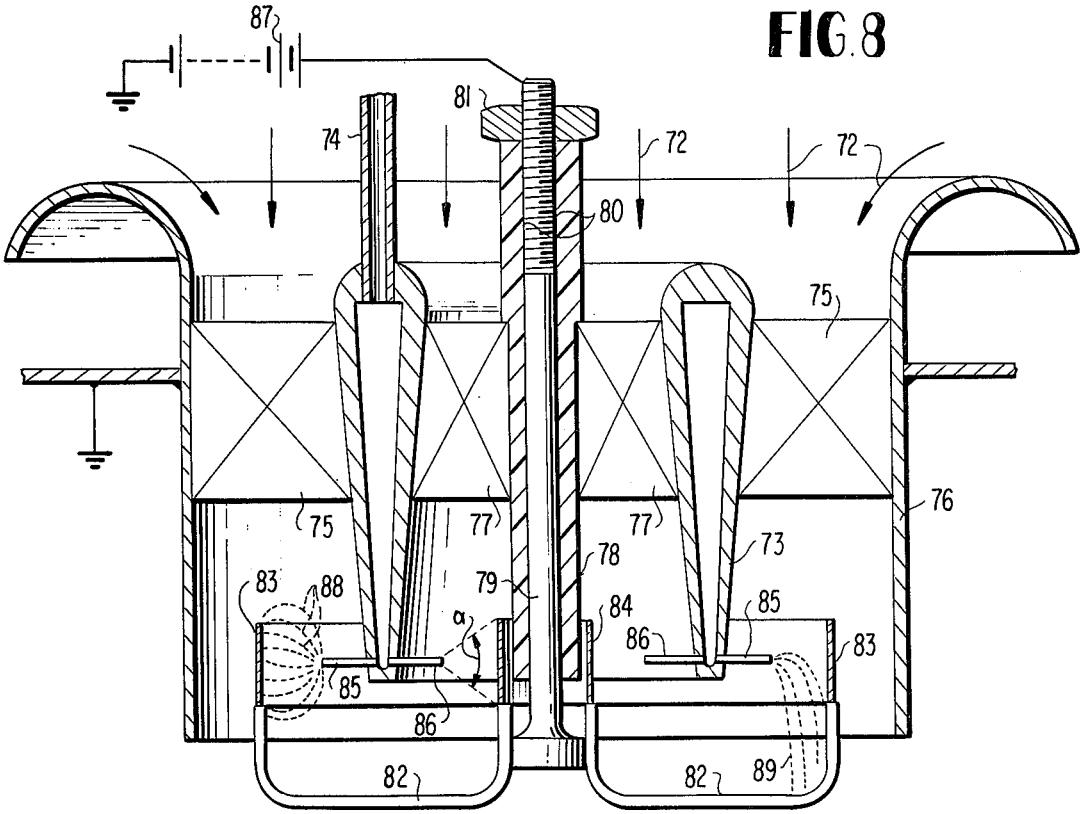
FIG. 8 is a somewhat schematic partial cross-sectional view, on an enlarged scale, through the fuel atomization installation of the gas turbine combustion chamber of FIG. 7.
Figure 9:
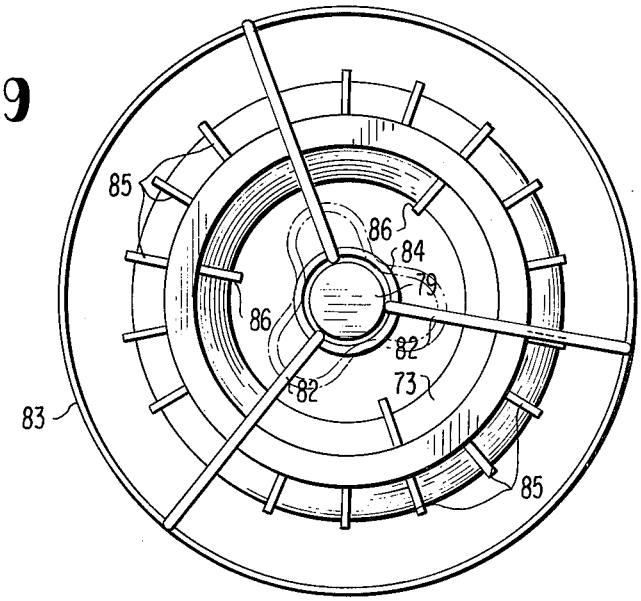
FIG. 9 is an axial view of the atomization installation according to FIG. 8.

The third embodiment of an electrostatic atomization installation according to FIGS. 7 to 9 is intended for gas turbine installations. Such a gas turbine installation is schematically illustrated in FIG. 7 whereby the combustion chamber installation generally designated by reference numeral 60 is illustrated enlarged with respect to the other parts. This gas turbine system consists as to the rest of the compressor 61, of the compressor turbine 62, of the working turbine 63, and of the heat-exchanger 64. The combustion chamber installation 60 includes an inner chamber 65 which, by reason of the different axial position of the supply openings for primary or combustion air (openings 66) and of those for preheated secondary-, mixture- or thinning air (openings 67) is adapted to be subdivided into different zones, namely, in an upper primary or combustion zone 68 and into a lower secondary-, mixture- or thinning zone 69. Above the combustion zone additionally a mixture-forming zone 70 can be distinguished which is located nearest to the atomization installation arranged in the tip of the chamber 65. The boundary areas between the zones are indicated in the drawing by dash and dotted lines. The atomization device is arranged in a zone 70 offset with respect to the combustion zone by reason of the atomization air entering therethrough, as indicated by the flow arrows 72.

The atomization installation illustrated in detail in FIG. 8 includes a streamlined ring-shaped double-walled nozzle assembly or nozzle stock 73 whose interior is connected with the fuel feed line 74. The nozzle stock 73 is concentrically retained within an air guide channel 76 by means of air-guide sheet-metal members 75. A tubularly shaped insulator 78 is held additionally in the center of the nozzle stock 73 by way of further air-guide sheet-metal members 77, on the inside of which a retaining screw 79 is axially adjustably retained by means of the threaded portion 80 and the counter-nut 81. Radially directed support arms 82 are arranged at the head of the mounting screw 79, at which are secured two ring electrodes 83 and 84 which extend with their walls parallel to the air stream. One rim each of radially extending small capillary tubes 85 and 86, i.e., arranged transversely in the air stream, are arranged at the end of the ring-shaped nozzle stock 73 which points downstream and terminates pointed in cross section. The small capillary tubes of a rim are arranged along a line extending transversely to the air stream, i.e., in a uniform cross plane. The small capillary tubes of both rims are also arranged among one another in a plane for purposes of simplification of the axial adjustment of the ring electrodes 83 and 84. The electrodes are so dimensioned and arranged that—with preservation of the arcing-over limit—the electrodes appear under a solid angle (angle $\alpha$) which is as large as possible, as viewed from a capillary tip. The number of small capillary tubes of a capillary rim is determined according to the air quantity which is able to flow toward the respective capillary rim. Since the outer clear cross-sectional area between the nozzle stock 73 and the air guide channel 76 is six times larger in the illustrated embodiment than the inner surface between the nozzle stock 73 and the insulator 78, the outer capillary rim has six times the number of capillaries than the inner capillary rim. As a result thereof, a distribution of the capillaries is achieved which is approximately equal over the flow area, and it is assured thereby that the mixture composition is approximately constant over the flow cross section.

FIG. 9 also shows in dash and dotted lines an arrangement in which the inner electrode is constructed garland-shaped with several outwardly concave arcs whose respective centers coincide at least approximately with the location of the discharge opening of an associated capillary tube of the inner capillary rim. This permits an increase in the surface at the inner capillary rim facing the capillary tips and therewith an increase in the effect of the field superelevation or increase.

The nozzle stock and the small capillary tubes as the other remaining component parts of the combustion chamber installation are placed at ground potential zero. The counter-electrodes 83 and 84 are placed at a high electric potential by way of the mounting arms 82 and the screw 79, which is indicated schematically by the voltage source 87 (FIG. 8). An electric field indicated schematically by field lines 88 forms as a result of this potential difference between the capillary tips and the opposite electrode surfaces, which owing to the exposed arrangement of the capillary tips has a local field line concentration in a desired manner. The thus-produced field super-increase with a high field strength gradient effects a fine atomization of the fuel liquid and an electric charging of the droplets. A wall impact of the droplets at the counter-electrode is prevented by reason of the atomization-air flowing past the electrode surfaces. The "cone" 89 (FIG. 8) of the atomization droplets which initially detaches itself from the capillary tips is blown away in the flow direction by the atomization air before the droplets have reached the counter-electrode. The forces acting aerodynamically on the droplets predominate thereby with respect to the electrostatic forces so that a wall impact is avoided.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An atomization installation for internal combustion engines for the atomization of fuel in an air stream, comprising a first internal combustion engine space means and a second atomization space means separate from said first space means and traversed by at least a part of the combustion air, an electrically conductive fuel supply means projecting into said second atomization space means and terminating therein, counter-electrode means electrically insulated with respect to the fuel supply means and arranged at a distance opposite to the fuel supply means, and means for applying a high voltage potential between the fuel supply means and the counter-electrode means, wherein said fuel supply means includes a plurality of small capillary tube means electrically connected with each other, mounting means for said small capillary tube means, said small capillary tube means freely projecting into said atomization space means from said mounting support means, fuel being able to flow through said small capillary tube means, said capillary tube means forming part of the fuel supply means, the counter-electrode means and being arranged facing with the electrode surface thereof the discharge openings of the small capillary tube means, and air guide means for guiding the air as regards flow velocity and flow direction at least within the area of the counter-electrode means in such a manner that the forces aerodynamically exerted on the atomized and electrically charged droplets by the flowing air predominate with respect to the electrostatic attracting forces exerted on the droplets by the counter-electrode means and thereby are operable to keep the droplets away from the counter-electrode means.

2. An installation according to claim 1, characterized in that the first space means is a combustion space.

3. An installation according to claim 1, characterized in that the first space means is a working space.

4. An installation according to claim 1, characterized in that the air flows in an orderly stream through the atomization space means.

5. An installation according to claim 1, characterized in that the fuel leaves the small capillary tube means substantially jet-free.

6. An installation according to claim 1, characterized in that the mutual distance of the capillary tube means, at least within the area of the discharge openings thereof, is larger than the distance of the discharge openings to the counter-electrode means.

7. An installation according to claim 6, characterized in that the freely projecting length of the capillary tube means is a multiple of the outer diameter of the capillary tube means within the area of the discharge opening.

8. An installation according to claim 7, characterized in that said freely projecting length is greater than the distance to the counter-electrode means.

9. An installation according to claim 7, characterized in that the wall thickness of the capillary tube means is relatively slight at least within the area of the discharge opening.

10. An installation according to claim 8, characterized in that the counter-electrode means is arranged relative to the capillary tube means—taking into consideration the arcing-over limit—in such a manner that the freely exposed electrode surface of the counter-electrode means appears under a relatively large solid angle—as viewed from any discharge opening of the capillary tube means.

11. An installation according to claim 10, characterized in that the distance of the freely exposed portions of the counter-electrode means to other freely exposed portions of the atomization installation electrically conductively connected with the capillary tube means is larger than with respect to the capillary tube tips.

12. An installation according to claim 11, characterized in that said freely projecting length is greater than the distance to the counter-electrode means.

13. An installation according to claim 12, characterized in that the wall thickness of the capillary tube means is relatively slight at least within the area of the discharge opening.

14. An installation according to claim 11, characterized in that the capillary tube means are arranged approximately parallel to the air stream and the counter-electrode means is arranged approximately transversely to the air stream and in that one through-flow opening is arranged coaxially to a respective capillary tube means within the counter-electrode means.

15. An installation according to claim 14, characterized in that the through-flow openings are dimensioned relatively small—under preservation of the limits of maximum permissive air velocities.

16. An installation according to claim 15, characterized in that the edges of the through-flow openings are bevelled off on the side facing the capillary tube means.

17. An installation according to claim 15, characterized in that the edges of the through-flow openings are rounded-off on the side facing the capillary tube means.

18. An installation according to claim 14, with means for a hydraulic/aerodynamic atomization of fuel and with a throttle valve means pivotally arranged in a flow channel means, characterized in that the plurality of capillary tube means is arranged upstream of the throttle valve means, as viewed in the flow direction, within an area of that part of the throttle valve means which is movable in the downstream direction from the closed position of the throttle valve means, said capillary tube means being electrically insulated with respect to the throttle valve means, and in that at least a part of the throttle valve means serves as counter-electrode means and is provided with a through-flow opening approximately coaxially to a respective capillary tube means.

19. An installation according to claim 18, characterized in that the plurality of capillary tube means is arranged at a place near the wall.

20. An installation according to claim 18, characterized in that the capillary tube means are electrically conductively connected with the metallic flow channel means, and the metallic throttle valve means is supported electrically and—except for the area with the through-flow openings on the side facing the capillary tube means—is covered with an insulating material of high dielectric strength.

21. An installation according to claim 11, characterized in that the capillary tube means are arranged substantially transversely to the air stream and the counter-electrode means is arranged substantially parallel to the air stream.

22. An installation according to claim 21, characterized in that the capillary tube means are arranged at least approximately along a line extending transversely to the flow direction.

23. An installation according to claim 22, characterized in that the capillary tube means are arranged radially at a nozzle stock means extending essentially in the air flow direction and in that the counter-electrode means is constructed as a cylindrical ring electrode means disposed substantially in the direction of the air flow.

24. An installation according to claim 23, characterized in that the capillary tube means are arranged in a common axial plane.

25. An installation according to claim 23, characterized in that the nozzle stock means is constructed as double-walled cylinder, in that the capillary tube means are arranged projecting radially outwardly and radially inwardly, and in that one ring electrode means each disposed in the air stream is arranged about the outer capillary rim and inside the inner capillary rim.

26. An installation according to claim 25, characterized in that the outer and the inner ring electrode means are constructed substantially cylindrically.

27. An installation according to claim 23, characterized in that the inner ring electrode means is constructed garland-shaped with severally outwardly concave arcs whose respective centers coincide at least approximately with the location of the discharge opening of an associated capillary tube means of the inner capillary rim.

28. An installation according to claim 1, characterized in that the freely projecting length of the capillary tube means is a multiple of the outer diameter of the capillary tube means within the area of the discharge opening.

29. An installation according to claim 28, characterized in that said freely projecting length is greater than the distance to the counter-electrode means.

30. An installation according to claim 1, characterized in that the wall thickness of the capillary tube means is relatively slight at least within the area of the discharge opening.

31. An installation according to claim 1, characterized in that the counter-electrode means is arranged relative to the capillary tube means—taking into consideration the arcing-over limit—in such a manner that the freely exposed electrode surface of the counter electrode means appears under a relatively large solid angle—as viewed from any discharge opening of the capillary tube means.

32. An installation according to claim 31, characterized in that the distance of the freely exposed portions of the counter-electrode means to other freely exposed portions of the atomization installation electrically conductively connected with the capillary tube means is larger than with respect to the capillary tube tips.

33. An installation according to claim 1, characterized in that the capillary tube means are arranged approximately parallel to the air stream and the counter-electrode means is arranged approximately transversely to the air stream and in that one through-flow opening is arranged coaxially to a respective capillary tube means within the counter-electrode means.

34. An installation according to claim 33, characterized in that the through-flow openings are dimensioned relatively small—under preservation of the limits of maximum permissive air velocities.

35. An installation according to claim 33, with means for a hydraulic/aerodynamic atomization of fuel and with a throttle valve means pivotally arranged in a flow channel means, characterized in that the plurality of capillary tube means is arranged upstream of the throttle valve means, as viewed in the flow direction, within an area of that part of the throttle valve means which is movable in the downstream direction from the closed position of the throttle valve means, said capillary tube means being electrically insulated with respect to the throttle valve means, and in that at least a part of the throttle valve means serves as counter-electrode means and is provided with a through-flow opening approximately coaxially to a respective capillary tube means.

36. An installation according to claim 35, characterized in that the plurality of capillary tube means is arranged at a place near the wall.

37. An installation according to claim 35, characterized in that the capillary tube means are electrically conductively connected with the metallic flow channel means, and the metallic throttle valve means is supported electrically and—except for the area with the through-flow openings on the side facing the capillary tube means—is covered with an insulating material of high dielectric strength.

38. An installation according to claim 1, characterized in that the capillary tube means are arranged substantially transversely to the air stream and the counter-electrode means is arranged substantially parallel to the air stream.

39. An installation according to claim 38, characterized in that the capillary tube means are arranged at least approximately along a line extending transversely to the flow direction.

40. An installation according to claim 38, characterized in that the capillary tube means are arranged radially at a nozzle stock means extending essentially in the air flow direction and in that the counter-electrode means is constructed as a cylindrical ring electrode means disposed substantially in the direction of the air flow.

41. An installation according to claim 38, characterized in that the capillary tube means are arranged in a common axial plane.

42. An installation according to claim 40, characterized in that the nozzle stock means is constructed as double-walled cylinder, in that the capillary tube means are arranged projecting radially outwardly and radially inwardly, and in that one ring electrode means each disposed in the air stream is arranged about the outer capillary rim and inside the inner capillary rim.

43. An installation according to claim 42, characterized in that the outer and the inner ring electrode means are constructed substantially cylindrically.

44. An installation according to claim 42, characterized in that the inner ring electrode means is constructed garland-shaped with severally outwardly concave arcs whose respective centers coincide at least approximately with the location of the discharge opening of an associated capillary tube means of the inner capillary rim.

45. An installation according to claim 1 wherein said electrode surface is flat.

* * * * *